US011725324B2

(12) United States Patent
Cho

(10) Patent No.: US 11,725,324 B2
(45) Date of Patent: Aug. 15, 2023

(54) WASHING MACHINE AND CONTROL METHOD THEREOF

(71) Applicant: LG Electronics Inc., Seoul (KR)

(72) Inventor: Younghan Cho, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 16/675,763

(22) Filed: Nov. 6, 2019

(65) Prior Publication Data

US 2020/0141042 A1 May 7, 2020

(30) Foreign Application Priority Data

Nov. 6, 2018 (KR) ..... 10-2018-0135105

(51) Int. Cl.
*D06F 21/02* (2006.01)
*D06F 33/48* (2020.01)
*D06F 34/18* (2020.01)

(52) U.S. Cl.
CPC ..... *D06F 33/48* (2020.02); *D06F 21/02* (2013.01); *D06F 34/18* (2020.02)

(58) Field of Classification Search
CPC ..... D06F 37/203; D06F 34/18; D06F 21/02; D06F 2103/24; D06F 2103/38; D06F 2105/48; D06F 2103/04; D06F 33/48; D06F 34/16
See application file for complete search history.

(56) References Cited

U.S. PATENT DOCUMENTS

2013/0312202 A1 11/2013 Balinski et al.
2014/0115792 A1 5/2014 Lee et al.
2015/0020319 A1 1/2015 Park et al.
2016/0289882 A1 10/2016 Song et al.
2018/0313014 A1* 11/2018 Kim ..... D06F 33/00

FOREIGN PATENT DOCUMENTS

| | | | | |
|---|---|---|---|---|
| CN | 101358418 | | 2/2009 | |
| CN | 103451891 | A * | 12/2013 | |
| CN | 103451891 | | 10/2015 | |
| EP | 2520700 | | 11/2012 | |
| EP | 2728049 | | 5/2014 | |
| EP | 3075895 | | 10/2016 | |
| EP | 3075895 | A1 * | 10/2016 | ..... D06F 34/16 |
| GB | 2269825 | | 2/1994 | |
| JP | 2008142231 | | 6/2008 | |
| KR | 20050012524 | | 2/2005 | |
| WO | WO-2017004787 | A1 * | 1/2017 | ..... D06F 33/44 |

OTHER PUBLICATIONS

Extended European Search Report in European Appln. No. 20176729.0, dated Sep. 29, 2020, 7 pages.
Partial European Search Report in European Application No. 19204337.0, dated Mar. 30, 2020, 14 pages.

* cited by examiner

*Primary Examiner* — Michael E Barr
*Assistant Examiner* — Pallavi Chitta
(74) *Attorney, Agent, or Firm* — Fish & Richardson P.C.

(57) ABSTRACT

A washing machine includes a cabinet including an entrance which is formed in a front surface of the cabinet such that laundry is input into or output from the entrance, a tub mounted inside the cabinet, a drum received in the tub and rotatably provided, a motor to provide driving force to rotate the drum, and a vibration sensor to sense vibration of the tub.

12 Claims, 9 Drawing Sheets

WASHING MACHINE AND CONTROL METHOD THEREOF

CROSS-REFERENCE TO RELATED APPLICATIONS

The present application claims priority under 35 U.S.C. 119 and 35 U.S.C. 365 to Korean Patent Application No. 10-2018-0135105, filed in Korea on Nov. 6, 2018, which is hereby incorporated by reference in its entirety.

BACKGROUND

The disclosure relates to a washing machine and a control method thereof.

In general, a washing machine is a device to complete washing work by properly mixing detergent and washing water, performing a washing stroke, and performing rinsing and dehydrating strokes when a user introduces contaminated laundry into a washing tank.

A drum washing machine may perform a washing operation as a drum into which laundry is introduced is horizontally rotated. The drum washing machine may start a washing stroke, as the laundry is introduced into the drum, an amount of water to be supplied is determined based on the weight of the laundry, and the water is started to be supplied. Hereinafter, the laundry may be named a laundry cloth or a cloth.

In addition, when the water level of a reservoir surrounding the drum reaches a set water level, a motor is driven, so the drum may be rotated. As the drum is rotated, the laundry falls, and thus the washing may be performed for a set time.

Thereafter, when the washing stroke is completed, the contaminated water in the reservoir is discharged to the outside through a drain pump, and the rinsing stroke and the dehydrating stroke are subsequently performed.

Meanwhile, the dehydrating stroke may be started when a degree (that is, cloth dispersion degree), in which the laundry (or cloth) is uniformly spread, is within an allowable range. In this case, the cloth dispersion degree may be named an unbalance state or the eccentric amount of the laundry.

The conventional washing machine performs a cloth dispersion operation of sensing the weight of the laundry, determining an amount of cloth, and making the laundry uniformly dispersed inside a drum based on the determined amount of cloth.

In addition, the conventional washing machine may determine the cloth dispersion degree (or the eccentric degree) of the laundry after performing the cloth dispersion operation is performed. For example, if the laundry is evenly dispersed, the motor may receive a uniform load and may be driven at a uniform rotational speed.

However, when the laundry is one-sided or agglomerated, the motor may receive the large load because the laundry one-sided or agglomerated is moved up by a lift. To the contrary, in the state that the lift is moved down, the motor receives the small load, so the rotational speed is not uniform, and greatly fluctuated.

In this case, a controller of the washing machine determines the cloth dispersion degree as being appropriate when the variation in the rotational speed is within a preset allowable range (or the eccentric amount of the laundry is within the allowable range).

To the contrary, the controller may determine the cloth dispersion degree is inappropriate when the variation in the rotational speed is out of the allowable range (or the eccentric amount of the laundry is beyond the allowable range). In addition, the controller performs a control operation such that the cloth dispersion operation is repeated, when the cloth dispersion degree is inappropriate.

In this case, the allowable range may be named an allowable cloth dispersion range. In addition, the conventional washing machine determines the allowable cloth dispersion range based on the weight of the laundry inside the drum. In this case, the conventional washing machine fails to suggest an appropriate allowable range even when the weight of the laundry is changed as the laundry has moisture.

Alternatively, the conventional washing machine performs the cloth dispersion operation depending on the weight of the laundry, so it is difficult to reduce the vibration and the noise. Accordingly, an unnecessary time is taken till the entrance into the dehydrating stroke.

Meanwhile, one of the main causes of the situation (unbalance) that the laundry is not uniformly dispersed inside the drum is the volume of the laundry. However, the conventional washing machine fails to reflect the variation in the unbalance characteristic resulting from the volume of the laundry.

For example, when laundry, such as mattress, having a larger volume is introduced, the conventional washing machine determines the allowable cloth dispersion range based on the weight of the laundry. Accordingly, even if the cloth dispersion operation is repeatedly performed, the preset allowable cloth dispersion range (or the allowable eccentric amount range) is not satisfied, thereby causing a serious problem of failing to enter the dehydrating stroke.

Information on the relevant prior art is as follows

Patent Document 1

KR10-2005-0012524 A entitled "CONTROL METHOD OF DEHYDRATING OF DRUM WASHING MACHINE"

SUMMARY

The present disclosure is provided to solve the problems occurring in the related art, and is to provide a washing machine and a control method thereof.

The present disclosure is to provide a washing machine and a control method thereof, capable of determining the volume of the laundry.

The present disclosure is to provide a washing machine and a control method thereof, capable of varying an allowable cloth dispersion range depending on the volume and the weight of the laundry.

In order to accomplish the object, according to an embodiment of the present disclosure, a washing machine may include a cabinet including an entrance which is formed in a front surface of the cabinet such that laundry is input into or output from the entrance, a tub mounted inside the cabinet, a drum received in the tub and rotatably provided, a motor to provide driving force to rotate the drum, and a vibration sensor to sense vibration of the tub.

In addition, the vibration sensor may be mounted at a rear end side defined by a rear surface of the tub, on which the motor is positioned, and a portion of a side surface extending forward along a circumference of the rear surface.

In addition, the washing machine may further include a spring to couple the tub to the cabinet in a vertical direction.

In the washing machine, the cabinet may include a gasket forming the entrance and coupled to a front end portion of the tub.

Further, the vibration sensor is mounted on an outer circumferential surface, which is positioned at a rear portion from the spring, of the tub.

In addition, the vibration sensor may include a six-axis vibration sensor.

In addition, the washing machine further include a controller to control an operating mode for washing the laundry, and the controller determines a volume of the laundry based on vibration data sensed by the vibration sensor.

In addition, the washing machine further include a memory to store, in advance, a table in which a volume value is matched to the vibration data based on a weight of the laundry. The controller determines the volume of the laundry through the table stored in the memory.

According to another aspect of the present disclosure, a control method of a washing machine, which includes, a cabinet including an entrance which is formed in a front surface of the cabinet such that laundry is input into or output from the entrance, a tub mounted inside the cabinet, a drum received in the tub and rotatably provided, a motor to provide driving force to rotate the drum, a vibration sensor to sense vibration of the tub, and a controller to control an operating mode for washing the laundry, may include performing a tumble motion for rotating the drum at a preset rotational speed to rinse the laundry; determining a stabilization time in which a rotational speed of the motor is stabilized; acquiring, by the controller, vibration data sensed by the vibration sensor after the stabilization time is elapsed; measuring a weight of the laundry and calculating a cloth amount level including the measured weight of the laundry, and determining, by the controller, a volume of the laundry based on the calculated cloth amount level and the vibration data.

In addition, the acquiring of the vibration data may include calculating, by the controller, an average vibration value based on the vibration data acquired.

In addition, the determining of the volume of the laundry may include calculating, by the controller, a volume value of the laundry through matching information of a volume value to the average vibration value depending on the cloth amount level stored in a memory.

The volume value of the matching information has a normalized value between '0' and '1'.

The control method may further include determining an allowable cloth dispersion value employing the volume of the laundry as a parameter; performing a cloth dispersion mode for rotating the drum such that the laundry is evenly dispersed inside the drum; and determining whether a variation in a rotational speed of the motor is within the determined allowable cloth dispersion value after the cloth distribution mode.

In addition, the controller controls to perform a dehydration mode when the variation in the rotational speed of the motor is within the determined allowable cloth dispersion value.

In addition, the tumble motion is performed multiple times.

Further, the vibration sensor is mounted on a rear end side of an outer circumference of the tub.

The present disclosure has the following effects.

First, since the volume of the laundry inside the drum may be determined, unnecessary acceleration or rotation may be prevented in the cloth dispersion mode. Accordingly, the power consumption of the washing machine may be reduced.

In addition, the volume of the laundry introduced into the drum is reflected, so the unbalance characteristic may be more exactly predicted. Accordingly, whether the cloth dispersion degree is appropriate may be more accurately determined depending on the type of the laundry.

In addition, the error of the entrance into the dehydration stroke due to the volume of the laundry may be prevented, so the reliability of the product may be improved.

In addition, since the entrance into the dehydration stork may be efficiently and appropriately performed depending on the weight and the volume of the laundry. Accordingly, the total washing time may be reduced.

In addition, since the inner unbalance of the drum is sensed based on the volume of the laundry, the vibration and the noise may be relatively reduced.

DETAILED DESCRIPTION OF THE EMBODIMENTS

Reference will now be made in detail to the embodiments of the present disclosure, examples of which are illustrated in the accompanying drawings.

In the following detailed description of the preferred embodiments, reference is made to the accompanying drawings that form a part hereof, and in which is shown by way of illustration specific preferred embodiments in which the present disclosure may be practiced. These embodiments are described in sufficient detail to enable those skilled in the art to practice the present disclosure, and it is understood that other embodiments may be utilized and that logical structural, mechanical, electrical, and chemical changes may be made without departing from the spirit or scope of the disclosure. To avoid detail not necessary to enable those skilled in the art to practice the disclosure, the description may omit certain information known to those skilled in the art. The following detailed description is, therefore, not to be taken in a limiting sense.

Also, in the description of embodiments, terms such as first, second, A, B, (a), (b) or the like may be used herein when describing components of the disclosure. Each of these terminologies is not used to define an essence, order or sequence of a corresponding component but used merely to distinguish the corresponding component from other component(s).

Figure 1:
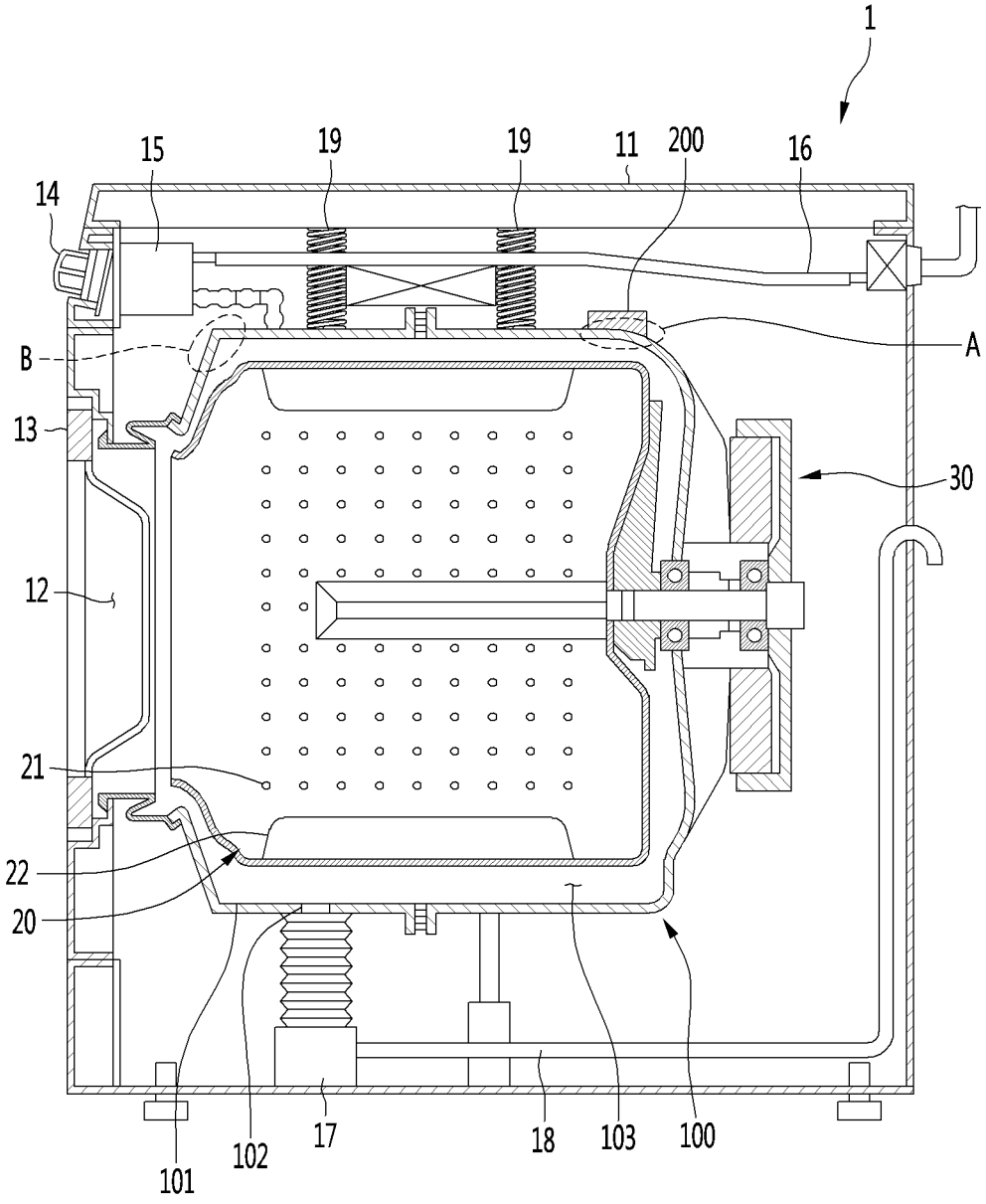
FIG. 1 is a view illustrating the configuration of a washing machine according to an embodiment of the present disclosure.

FIG. 1 is a view illustrating the configuration of a washing machine according to an embodiment of the present disclosure.

Referring to FIG. 1, according to an embodiment of the present disclosure, a washing machine 1 may include a cabinet 11 having an inner space formed therein and a tub 100 positioned in the inner space of the cabinet 11.

The cabinet 11 may be formed in a front surface thereof with an entrance 12 allowing a laundry to be input or output. For example, the cabinet 11 may be formed in a substantially box shape. Hereinafter, for convenience of description, the laundry may be named a laundry cloth or a cloth.

The tub 100 may be mounted inside the cabinet 11. For example, the tub 100 may be formed in a substantially cylindrical shape.

The tub 100 may be provided in the form of lying inside the cabinet 11. In addition, the tub 100 may have a front surface facing the entrance 12.

In addition, the tub 100 may be provided in a structure that is suspended to the cabinet 11 by a spring 19 and a damper (not illustrated). For example, the spring 19 may be coupled to the cabinet 11 at the upper portion thereof, and may be coupled to the tub 100 to the lower portion thereof.

The spring 19 may be coupled to an outer circumference surface of the tub 100. In addition, the spring 19 may be coupled to the center of the tub 100. For example, when viewed based on FIG. 1, the spring 19 may be coupled to a bisecting point of a side surface of the tub 100 having the cylindrical shape while extending vertically.

In addition, a plurality of springs 19 may be provided.

The tub 100 may be formed therein with a washing space 103 filled with washing water. A drum 20 may be received in the washing space 103.

The tub 100 is provided at a lower portion thereof with a water collector 101 to collect washing water. The water collector 101 may be formed as an inner bottom surface of the tub 100 is recessed downward. Accordingly, the washing water may be easily collected in the water collector 101.

The water collector 101 may include a drain port 102 communicating with a drainpipe 18 to be described so as to drain the washing water.

The cabinet 11 may include an operating device 14 to handle the operation of the washing machine 1. For example, the operating device 14 may be positioned at an upper portion of a front surface of the cabinet 11.

The cabinet 11 may further include a detergent box 15 which is introduced into and withdrawn out of the cabinet 11. For example, the detergent box 15 may be positioned at an upper portion of a front surface of the cabinet 11. In other words, the detergent box 15 may be positioned at a side portion of the operating device 14. The user may withdraw the detergent box 15 and introduce detergent into the detergent box 15.

The cabinet 11 may further include a water supplying pipe 16 to supply the washing water into the tub 100. The water supplying pipe 16 may be connected with an external water supply source. In addition, the water supplying pipe 16 may extend into the cabinet 11 by passing through the cabinet 11.

The water supplying pipe 16 may be connected with the tub 100 through the detergent box 15. Accordingly, the water supplying pipe 16 allows the detergent introduced into the detergent box 15 to be supplied to the tub 100 together with the washing water.

The cabinet 11 may further include a drain pump 17 and the drainpipe 18 positioned below the tub 100 in the inner space thereof to circulate the washing water and drain the washing water.

The drainpipe 18 may be connected with one side of the bottom surface of the tub 100. In addition, the drainpipe 180 may extend to the outside of the cabinet 11.

The drainpipe 17 may be mounted on a flow passage of the drainpipe 18. Accordingly, the drain pump 17 may forcibly drain the washing water.

The washing machine 1 may further include a door 13 to open or close the entrance 12. The door 13 may be rotatably provided on the cabinet 11. In addition, the door 13 may open or close the entrance 12 through the rotation.

The washing machine 1 may include a drum 20 rotatably mounted inside the tub 100 to wash laundry and a motor 30 mounted in the tub 100 to rotate the drum 20.

The drum 20 may be received in the washing machine 103 of the tub 100.

The drum 20 may be formed in the substantially cylindrical shape and may have a space to receive the laundry therein. For example, the drum 20 may be provided in the form of lying inside the tub 100.

The drum 20 may be formed in size smaller than the washing space 103 of the tub 100. In addition, an outer surface of the tub 100 may be spaced apart from an inner surface of the tub 100.

In addition, the drum 20 may be open toward the entrance 12. Accordingly, the laundry may be introduced into or withdrawn out of the drum 20 through the entrance 12.

The drum 20 may have a plurality of holes 21 formed along the circumference thereof such that the washing water passes through the holes 21.

When the drum 20 rotates, the washing water supplied into the tub 100 may be supplied into the drum 20 or may be discharged out of the drum 20 through the holes 21. In other words, the washing water in the washing space 103 may be circulated into the drum 20.

The motor 30 may be provided on the rear surface of the tub 100. In other words, the motor 30 may be provided on an outer rear surface of the tub 100 opposite to the open front surface of the tub 100. In addition, the rotational shaft of the motor 30 may be connected with the drum 20 through the rear surface of the tub 100.

In other words, the drum 20 may be coupled to the rotational shaft of the motor 30. In addition, the drum 20 may be provided in the washing space 103 to be rotatable in the washing space 103.

In this case, the rotational shaft of the motor 30 may be formed horizontally to the ground surface. In other words, the drum 20 is rotated about the rotational shaft horizontal to the ground surface such that the laundry received in the drum 20 is moved up and falls.

The drum 20 may be provided on an inner surface thereof with a lift 22 to move up the laundry when the drum 20 rotates.

The lift 22 may be provided to protrude from the inner circumferential surface of the drum 20. In addition, a plurality of lifts 22 may be provided to be spaced apart from each other along the circumference of the inner circumferential surface of the drum 20.

When the washing machine 1 performs a washing mode (or washing stroke), the washing water may be supplied to the washing space 103 of the tub 100 through the water supply pipe 16.

The wash water supplied into the tub 100 may be filled from the bottom of the tub 100. The washing water filled in the tub 100 may be circulated into the drum 20 through the holes of the drum 20.

When the washing water is sufficiently supplied into the tub 100, the motor 30 may be operated to rotate the drum 20. When the drum 20 is rotated, the laundry inside the drum 20 may be moved up by the lift 22 and then washed by washing water while falling.

Thereafter, when the washing is completed, the motor 30 is stopped, and the drain pump 17 may be operated.

When the drain pump 17 is operated, the washing water inside the tub 100 may be drained to the outside through the drain port 102 and the drainpipe 18. The washing machine 1 may perform a rinsing mode when the washing mode is completed.

The washing machine 1 may further include a controller (not shown) to control the driving mode and a memory (e.g., a non-transitory memory device) to store information.

The controller may include a micro-controller.

The controller may detect time and may control water supply, drainage, and the rotational speed of the motor 30. In addition, the controller may process the vibration data sensed by a vibration sensor 200 to be described later, and may control the operation mode of the washing machine 1 based on the vibration data.

The memory may store the vibration data sensed in an acquisition duration of a tumble motion to be described later. An average vibration value acquired in the tumble motion may be stored in the memory The memory may store, in advance, information for leveling the weight of laundry sensed in a cloth amount detection mode to be described later. In addition, the memory may store data on the volume on laundry matched to each vibration data based on the weight or the level information.

The controller may determine the weight and the volume of the laundry using the information stored in the memory. The details thereof will be described below.

The washing machine 1 may further include a vibration sensor 200 to sense vibration of the tub 100.

The vibration sensor 200 may include a six-axis vibration sensor.

The vibration sensor 200 may be mounted on the tub 100. For example, the vibration sensor 200 may be mounted on the outer circumferential surface of the tub 100.

The outer circumferential surface of the tub 100 may be defined as the rear end side "A" and the front end side "B".

In detail, the rear end side "A" of the tub 100 may be defined as an outer circumferential surface of the tub 100 located rearward of the spring 19. In other words, the rear end side "A" of the tub 100 may include a rear surface ion which the motor 30 is positioned and a portion of a side surface extending forward along the outer circumference of the rear surface.

To the contrary, the front end side "B" of the tub 100 may be defined as an outer circumferential surface of the tub 100 located forward of the spring 19. In other words, the front end side "B" of the tub 100 may include a front surface coupled to a gasket having the entrance 12 and a remaining portion of the side surface.

The vibration sensor 200 may be mounted on the rear end side A of the tub 100.

Hereinafter, it is more advantageous when the vibration sensor 200 is mounted on the front end side "B" rather than the rear end side "A", and the reason for that will be described below in detail.

Figure 2A:
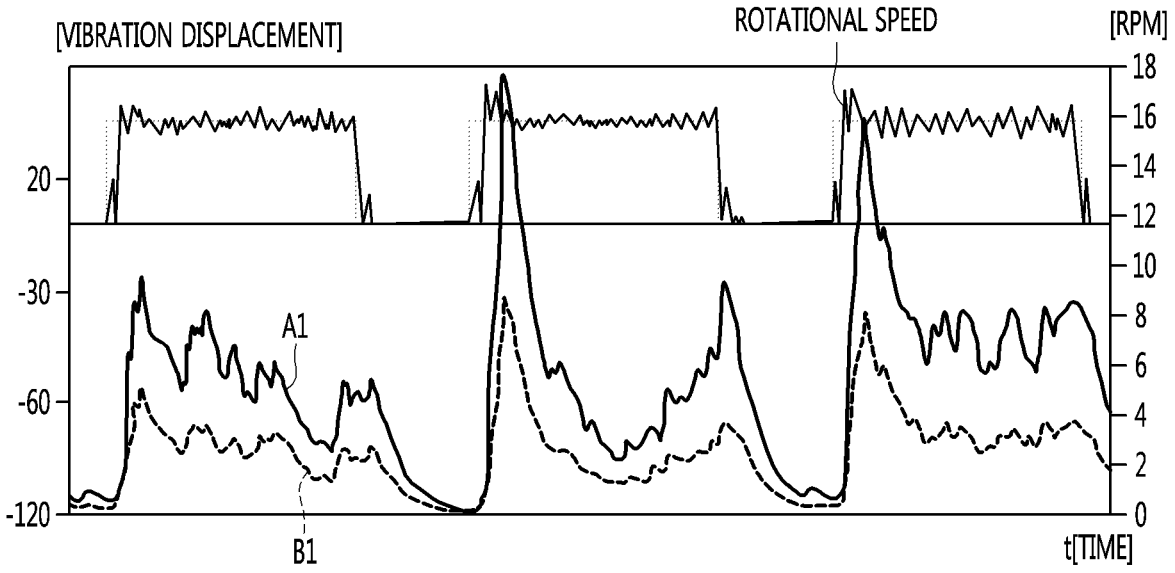
FIG. 2A is a graph illustrating experimental data obtained by measuring left-and-right vibrations of the tub depending on the installation positions of the vibration sensor, according to an embodiment of the present disclosure.
Figure 2B:
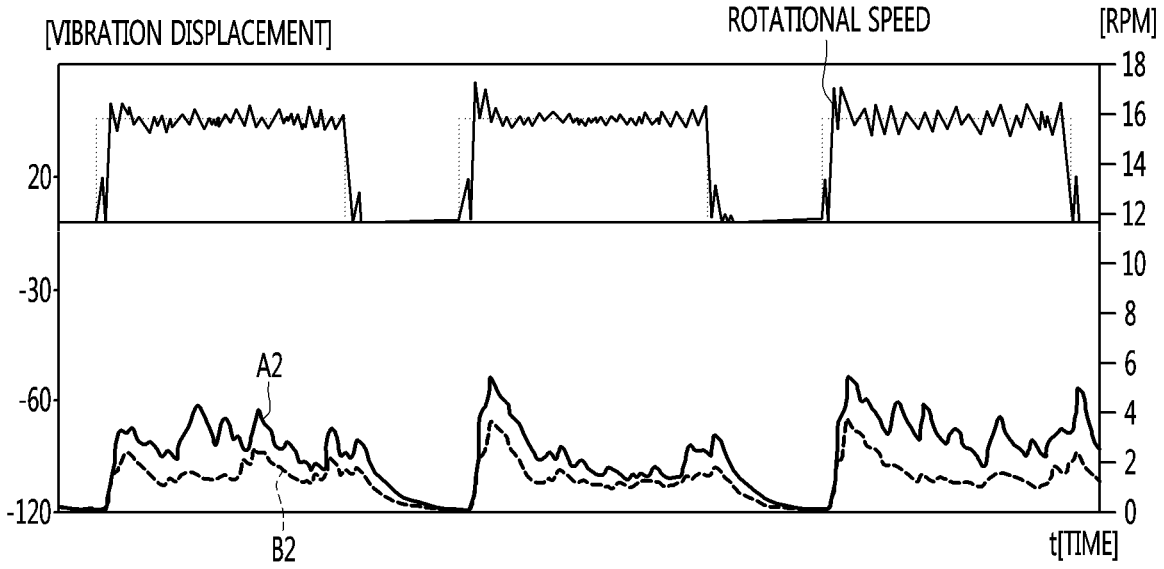
FIG. 2B is a graph illustrating experimental data obtained by measuring the up-and-down vibration of the tub depending on the installation position of the vibration sensor according to an embodiment of the present disclosure.

FIG. 2A is a graph illustrating experimental data obtained by measuring the left-and-right vibrations of the tub depending on the installation positions of the vibration sensor, according to an embodiment of the present disclosure, and FIG. 2B is a graph illustrating experimental data obtained by measuring the up-and-down vibration of the tub depending on the installation position of the vibration sensor, according to an embodiment of the present disclosure.

In detail, FIG. 2A is a graph illustrating the measurement of the left-and-right vibration of the tub 100 over a time, when the periodical rotational operation of the drum 20 is performed as the motor 20 is driven in a rinsing operation. In addition, FIG. 2A is a graph illustrating the measurement of the up-and-down vibration of the tub 100 over a time, when the periodical rotational operation of the same drum 20 is performed as the motor 20 is driven in a rinsing operation.

Meanwhile, the drum 20 vertically and horizontally shakes the laundry inside the drum 20 as the motor 30 is driven. Accordingly, the vibration (front-end-rear vibration) of the tub 100, which is generated in a front and rear direction of the tub 100 may be less than the vibration (left-and-right vibration) of the tub 100, which is generated in a left and right direction, or the vibration (up-and-down vibration) of the tub 100 which is generated in a up and down direction. Accordingly, the front-and-rear vibration of the tub 100 may be omitted in the following description of the method for sensing the volume of the laundry.

Referring to FIG. 2A, when the vibration sensor 200 is mounted on the rear end side "A", the left-and-right vibration "A1" (solid line) may show a periodical waveform depending on the driving of the motor even through the variation width of a vibration displacement is slightly changed.

The motor 30 may be driven at a preset rotational speed for a preset time. For example, the motor 30 may be controlled to be repeatedly driven and stopped. Accordingly, the motor 30 may be periodically driven.

The left-and-right vibration "A1" of the rear end side may make the greatest vibration in the vibration displacement when the driving of the motor 30 is started within one period. In addition, the left-and-right vibration "A1" of the rear end side may make the displacement variation gradually reduced as the driving time of the motor 30 is elapsed.

Meanwhile, when the vibration sensor 200 is mounted on the front end side "B", it may be recognized that the left-and-right vibration "B1" (dotted line) of the tub 100 is smaller than the left-and-right vibration of the rear end side "A1" in the sensed displacement value.

Referring to FIG. 2B, when the vibration sensor 200 is mounted on the rear end side "A", the up-and-down vibration "A2" (solid line) may show a periodical waveform depending on the driving of the motor even through the variation width of a vibration displacement is slightly changed.

Similarly to the left-and-right vibration, the up-and-down vibration "A2" of the rear end side may make the greatest variation in the vibration displacement when the driving of the motor 30 is started within one period. In addition, as the driving time of the motor 30 is elapsed, the vibration displacement value may be gradually reduced.

Alternatively, when the vibration sensor 200 is mounted at the front end side "B", it may be recognized that the up-and-down vibration "B2" (dotted line) of the tub 100 is smaller than the up-and-down vibration "A2" of the rear end side in the sensed displacement value.

In summary, as illustrated in FIGS. 2A and 2B, the vibration sensor 200 mounted on the rear end side "A" of the tub 100 may sense the vibration of the tub 100 more sensitively and finely as compared to the vibration sensor 200 mounted on the front end side "B" of the tub 100.

The reason for the above-mentioned result is because the front surface or front end of the tub 100 is more firmly coupled to the gasket forming the entrance 12. Accordingly, the front side B of the tub 100 may cancel the vibration by the gasket integrally coupled to the cabinet 11.

Therefore, the vibration value sensed from the vibration sensor 200 mounted at the rear end side A of the tub 100 is advantageous to perform determination more accurately and finely. Therefore, the vibration sensor 200 according to the embodiment of the disclosure may be mounted on the rear end side "A" of the tub 100.

Meanwhile, when comparing the vibration displacement of the left-and-right vibration (see FIG. 2A) of the tub 100 and the up-and-down vibration (see FIG. 2B) of the tub 100 described above, it may be recognized that the larger vibration displacement value may be sensed in the left-and-right vibration of the tub 100.

This is because the spring 19 and the damper (not illustrated), which are elastic devices, are provided to connect the cabinet 11 to the tub 100 in the vertical direction. Accordingly, the up-and-down vibration of the tub 100 may be canceled by the spring 19 and the damper.

Accordingly, the use of the left-and-right vibration of the tub 100, which is able to detect the vibration displacement more sensitively and finely, is more advantageous than the data on the up-and-down vibration, so as to determine the volume of the laundry based on the vibration value sensed by the vibration sensor 200.

In other words, in the washing machine 1 according to an embodiment of the present disclosure, the data on the left-and-right vibration of the tub 100, which is sensed through the vibration sensor 200 mounted on the rear end side "A" of the tub 100, may be used as a main factor to sense and identify the volume of the laundry.

Figure 3:
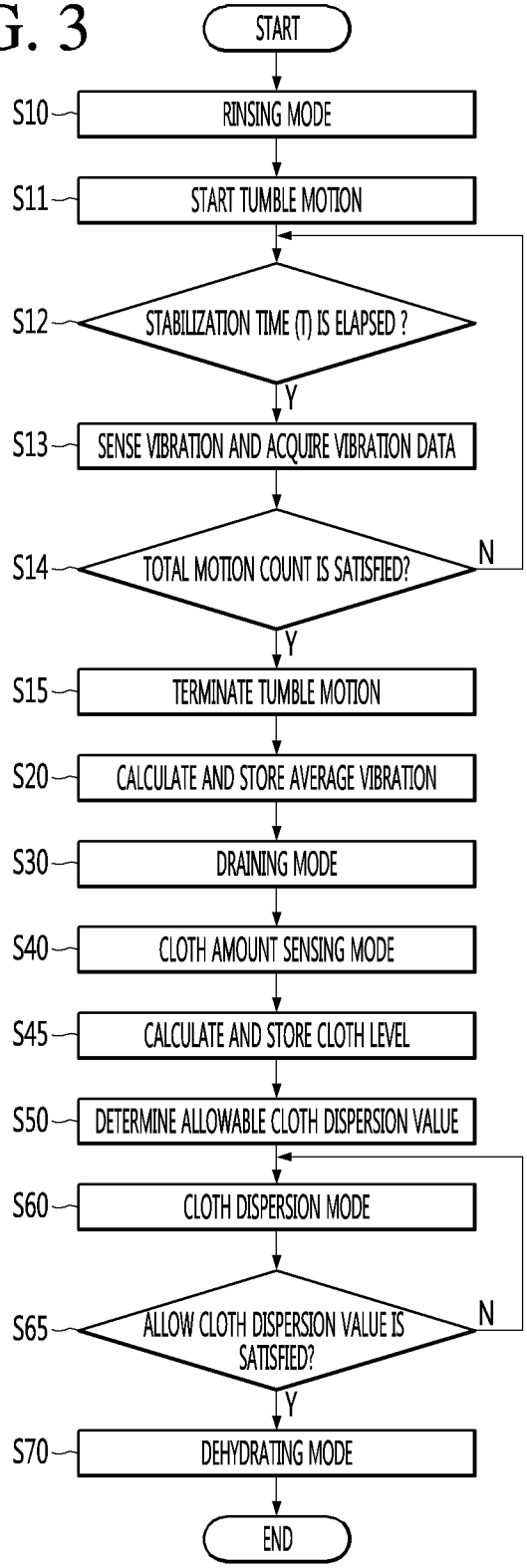
FIG. 3 is a flowchart illustrating a control method of a washing machine according to an embodiment of the present disclosure.
Figure 4:
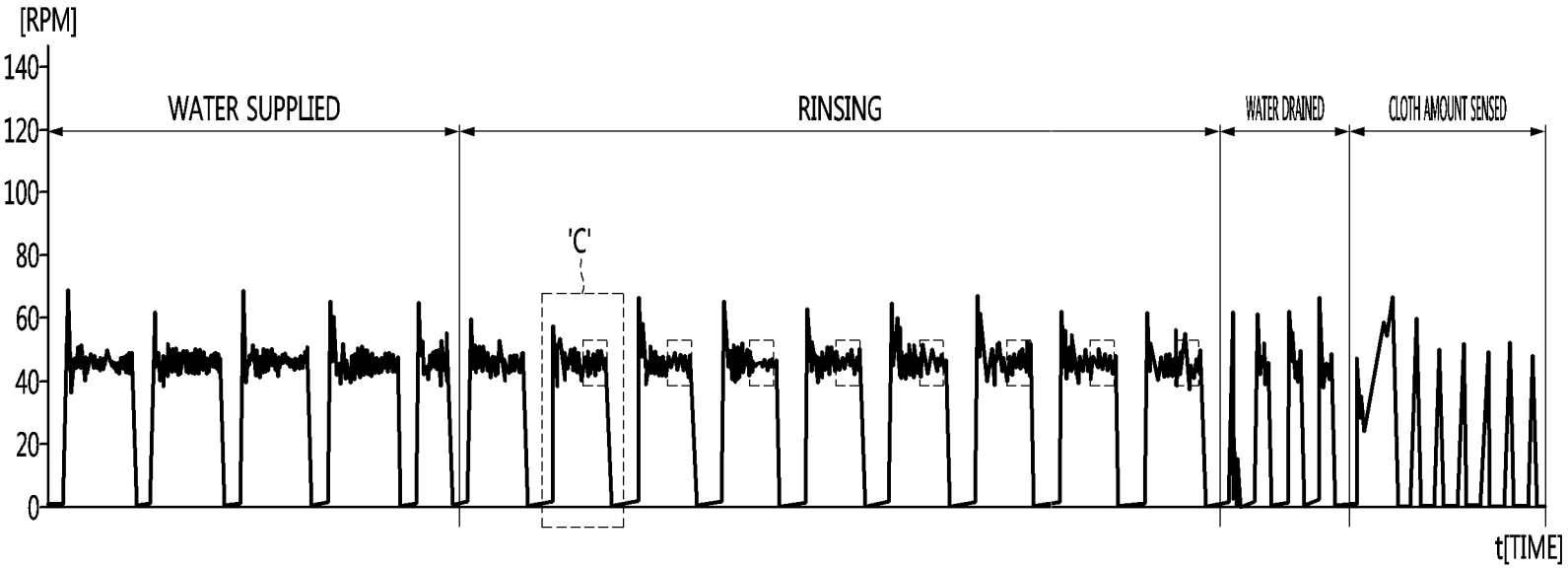
FIG. 4 is an operation graph illustrating the duration for acquiring vibration data of the washing machine according to an embodiment of the present disclosure.
Figure 5:
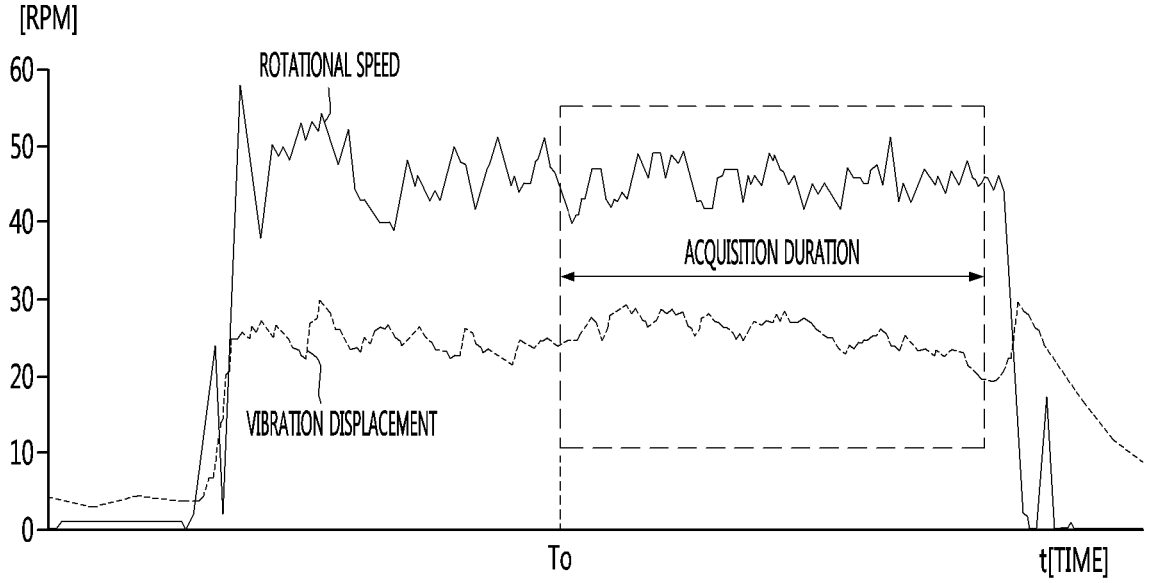
FIG. 5 is an enlarged view illustrating part 'C' of FIG. 4.

FIG. 3 is a flowchart illustrating a control method of a washing machine according to an embodiment of the present disclosure, FIG. 4 is an operation graph illustrating the duration for acquiring vibration data of the washing machine according to an embodiment of the present disclosure, and FIG. 5 is an enlarged view illustrating part 'C' of FIG. 4.

Referring to FIGS. 3 to 5, the washing machine 1 may enter a rinsing mode (or rinsing stroke) after the washing mode (or the washing stroke) is completed (S10).

The rinsing mode may include a water supplying step of supplying water into the drum 20 to rinse the laundry.

The washing machine 1 may start the tumble motion for rinsing the laundry when the water supplying is completed (S11).

In detail, when the controller of the washing machine 1 determines water as being completely supplied, the controller of the washing machine 1 may control the motor 30 to perform the tumble motion of rotating the drum 20 at a preset rotational speed for a specific time several times so as to rinse the laundry.

In the tumble motion, the controller may perform a control operation such that the rotational speed of the motor 30 maintains a preset rotational speed. In this case, the preset rotational speed of the motor 30 may be set to a value between 40 RPM and 50 RPM, for example, 46 RPM. In addition, the preset rotational speed may be the same as the rotational speed of the drum 20.

In addition, the preset time at which the motor 30 is driven in the tumble motion may be set to be between 20 seconds and 25 seconds. In addition, the preset time at which the motor 30 is driven in the tumble motion may be set to 21 seconds.

Meanwhile, the motor 30 needs a stabilization time to reach and maintain the preset rotational speed. The stabilization time may be understood as an initial driving time taken until the motor 30 reaches the steady state in which the motor 30 stably and constantly (e.g., 46 RPM) maintains the rotational speed.

During the stabilization time, the rotational speed of the motor 30 is highly fluctuated and may deviate from the target rotational speed. Accordingly, the vibration value sensed by the vibration sensor 200 during the stabilization time may be affected by the fluctuating rotational speed of the motor 30.

In detail, referring to FIG. 5, it may be recognized that the vibration displacement of the tub 100 shows a waveform that follows the driving characteristics of the motor 30 for the duration in which the rotational speed of the motor 30 is severely fluctuated, that is, for a stabilization time, In other words, the vibration value sensed by the vibration sensor 200 for the stabilization time may not be treated as data reflecting the properties (e.g., volume) of the internal laundry and may have lower reliability because the rotational speed of the motor 30 varies with the great width.

The controller may perform a control operation such that the tumble motion is performed multiple times. For example, nine tumble motions may be performed in total.

The controller may stop the driving of the motor 30 for a predetermined time after the end of the tumble motion and before the next tumble motion is performed. The waiting time may be set between the plurality of tumble motions.

The motor 30 may be periodically driven and stopped a plurality of times to perform each tumble motion. Therefore, the motor 30 may go through the stabilization time for each tumble motion.

Therefore, when the tumble motion starts, the washing machine 1 may determine whether the stabilization time TO has elapsed (S12).

In detail, the controller may detect the elapsed time when the tumble motion is started. The controller may determine whether the stabilization time TO has elapsed. For example, the stabilization time TO may be set to a time between 8 seconds and 14 seconds.

When the stabilization time TO has elapsed, the washing machine 1 may detect vibration (S13).

In detail, when the stabilization time TO has elapsed, the rotational speed of the motor 30 may enter into a duration in which the preset rotational speed (e.g., 46 RPM) is maintained to be in a predetermined range.

The duration in which the preset rotational speed (e.g., 46 RPM) is maintained to be in a predetermined range may be named an "acquisition duration". For example, the acquisition duration may be set from 15 seconds to 20 seconds excluding the stabilization time when the total driving time of the motor 30 in the tumble motion is 21 seconds. Meanwhile, the motor 30 is completely stopped after 21 seconds and may wait until the next tumble motion is performed.

After the stabilization time TO has elapsed, the controller may receive a vibration value sensed by the vibration sensor 200 in real time. Accordingly, the controller may acquire vibration data in the acquisition duration. In this case, the vibration data may include an average of the values obtained by detecting the left-and-right vibration of the tub 100.

Meanwhile, when the rotational speed of the motor 30 is maintained to the preset rotational speed (e.g., 46 RPM), and when a smaller volume of laundry is present inside the drum 20, the average and the standard deviation of the vibration values sensed by the vibration sensor 200 may be less values. To the contrary, in the case of laundry which is easy to be tangled and bulky, the average and standard deviation of the vibration values sensed by the vibration sensor 200 may be grater values.

The controller may calculate an average (hereinafter, referred to as an "individual average vibration value") of vibration values sensed by the vibration sensor 200 in the acquisition duration and may store the average in the memory.

As described above, the tumble motion may be performed a plurality of times. The next tumble motion may be started after the waiting time has elapsed.

Therefore, the washing machine 1 may determine the number of performed tumble motions when each tumble motion is terminated. In detail, the controller may determine whether the number of times of performing the tumble motions satisfies the total number of motions N after acquiring the vibration data (S14).

The total number of motions N may be defined as the total number of tumble motions to be performed in the rinsing mode. For example, the total number of motions N may be nine times.

The controller may perform a control operation to repeat step S12 when the number of times of performing the tumble motion is not satisfied with the total number of motions N. Accordingly, the controller may acquire vibration data of the next tumble motion and store the vibration data in the memory.

Accordingly, since the controller may acquire the vibration data by the total number of motions N, an error may be reduced and the left-and-right vibration data of the tub 100, which is more reliable, may be acquired.

When the number of times of performing the tumble motion satisfies the total number of motions N, the tumble motion may be terminated (S15).

After the tumble motion is finally terminated, the washing machine 1 may calculate an average vibration value based on the obtained vibration data. The calculated average vibration value may be stored in the memory (S20).

The memory may store the vibration data sensed in the acquisition duration of each tumble motion. In addition, the individual average vibration value calculated as the vibration data acquired in each tumble motion may also be stored in the memory.

The controller may calculate the average of the vibration value sensed in the whole tumble motion based on the vibration data or the individual average vibration value which is stored in the memory.

Hereinafter, the average of the vibration values sensed in the whole tumble motion is defined as an average vibration value.

The calculated average vibration value may be stored in the memory (S20).

When the calculation and storage of the average vibration value are completed, the washing machine 1 may perform a draining mode (S30).

In detail, in the draining mode, the controller may operate the drain pump 17 to drain the water inside the tub 100 to the outside through the drainpipe 18.

When the drain mode is completed, the washing machine 1 may perform a cloth amount sensing mode (S40).

In the cloth amount sensing mode, the weight of the laundry introduced into the drum 20 may be sensed. In detail, in the cloth amount sensing mode, the controller may rotate the drum 20 such that the speed of the drum 20 reaches a specific speed. For example, the specific speed may be about 70 RPM.

The controller may measure an arrival time taken to reach the specific speed. When the weight of the laundry is increased, the arrival time is relatively increased, so the controller may measure the weight of the laundry by measuring the arrival time.

The washing machine may calculate and store a cloth amount level that is matched the measured laundry weight (S45) (S45)

In detail, the memory may store, in advance, the cloth amount level for the weight range of the laundry in the form of a table. For example, the cloth amount level may be defined as level #1 when the weight of the laundry (see Load Data of FIG. 6) is the range of 0 to 420, as level #2 when the weight of the laundry is the range of 420 to 480, as level #3 when the weight of the laundry is the range of 480 to 770, as level #4 when the weight of the laundry is the range of 770 to 930, as level #5 when the weight of the laundry is in the range of 930 to 1220, and as level #6 when the weight of the laundry is in the range of 1220 to 1520.

The controller may calculate a corresponding cloth amount level by matching the weight of the laundry measured in the cloth amount sensing mode to cloth amount levels using the cloth amount level table stored in the memory. The calculated cloth amount level may be stored in the memory.

When the calculation and storage of the cloth amount level are completed, the washing machine 1 may determine the allowable cloth dispersion value (S50).

The allowable cloth dispersion value may be determined based on the calculated cloth amount level and the average vibration value.

The memory may store, in advance, a table in which volume values are matched to average vibration values with respect to the cloth amount levels. For example, the memory stores the matching information of the volume value to the average vibration value when the cloth amount level is level #4.

The volume value for the average vibration value may be provided as a normalized value between 0 and 1.

The controller may determine the allowable cloth dispersion value by using the table stored in the memory. Accordingly, the controller may change the allowable dispersion value, which is a criterion for determining a cloth dispersion degree, based on the weight and volume of the laundry.

Meanwhile, the allowable cloth dispersion value may be expressed a numeric value range. Accordingly, the allowable cloth dispersion value may be named an "allowable cloth dispersion range".

Hereinafter, the method for determining the allowable cloth dispersion value will be described.

When the allowable cloth dispersion value is determined, the washing machine 1 may perform a cloth dispersion mode (S60).

The cloth dispersion mode may be understood as a mode for controlling the operation of the drum 20 such that the laundry introduced into the drum 20 is evenly dispersed. For example, the controller may accelerate the drum 20 to a laundry adhering speed at an acceleration slope determined according to the weight of the laundry. In this case, the laundry may be evenly dispersed during the acceleration process of the drum 20. Herein, the laundry adhering speed may be defined as a speed at which the laundry is adhered to the inner wall of the drum by centrifugal force.

In this case, the laundry adhering speed may be set to 108 RPM.

After the dispersing mode is performed, the washing machine 1 may determine whether the allowable cloth dispersion value is satisfied (S65).

In detail, when the rotational speed of the drum 20 reaches the laundry adhering speed, the controller may determine whether the variation in the rotational speed of the motor 30 satisfies the allowable cloth dispersion value (or range).

When the cloth dispersion degree is inappropriate, and when a part that the laundry is one-sided or agglomerated is moved up by the lift 22, the motor 30 receives the large load. To the contrary, the motor 30 receives the small load when the part is moved down. In such a principle, the controller may determine whether the allowable cloth dispersion value (or range) is satisfied based on the variation of the rotation speed of the motor 30 at the laundry adhering speed.

The satisfaction of the allowable cloth dispersion value (or range) may be understood as determining whether the degree, that is, the cloth dispersion degree, that the laundry is evenly dispersed inside the drum 20 is appropriate.

The controller may determine that the laundry in the drum 20 is uniformly and evenly dispersed, when the variation in the rotational speed satisfies the allowable cloth dispersion value. In other words, the controller may determine that the cloth dispersion degree is appropriate (or the eccentric amount of the laundry is within the allowable range).

When it is determined that the cloth dispersion degree is appropriate, the washing machine 1 may perform a dehydration mode (or a dehydration stroke) (S70).

To the contrary, the controller may determine the cloth dispersion degree is inappropriate when the variation in the rotational speed of the motor 30 is out of the allowable cloth dispersion value or the allowable cloth dispersion range (or the eccentric amount of the laundry is beyond the allowable range).

When it is determined that the cloth dispersion degree is inappropriate, the controller may perform a control operation to repeat the cloth dispersion mode (S60).

Therefore, according to an embodiment of the present disclosure, since the washing machine 1 may apply the allowable cloth dispersion value varied depending on the weight and the volume of the laundry, the washing machine 1 may more reduce the vibration and the noise as compared with the case that the allowable cloth dispersion value is determined based on the weight of the conventional washing machine.

In addition, the washing machine 1 may prevent an unnecessary cloth dispersion operation from being repeated when the bulky laundry, such as a mattress, is introduced, which is different the conventional washing machine, so the operating time of the washing machine may be reduced.

Figure 6:
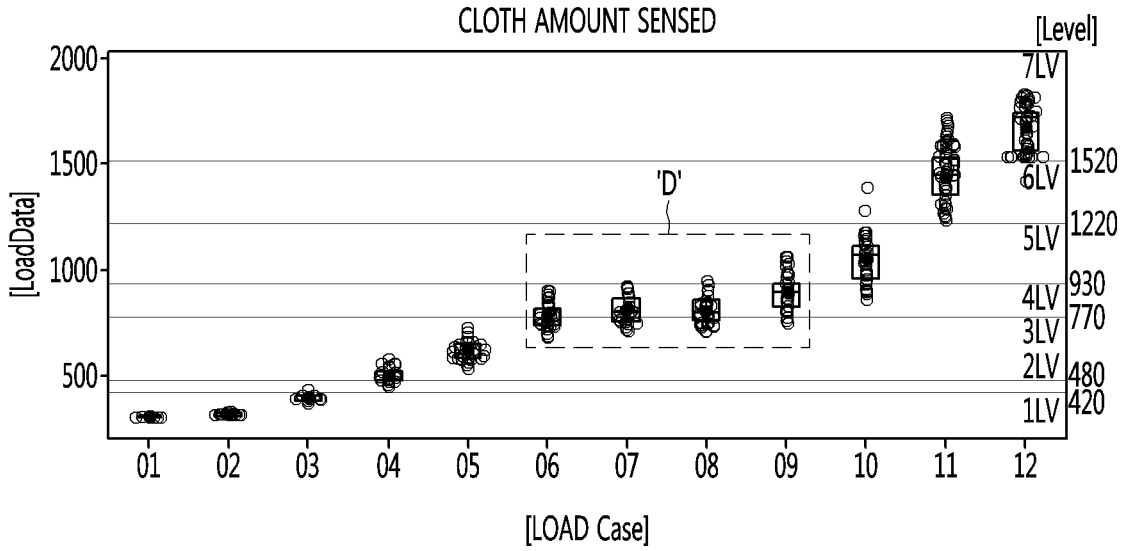
FIG. 6 illustrate experimental data obtained by measuring a load level to a load case in the cloth amount sensing mode according to an embodiment of the present disclosure.
Figure 7:
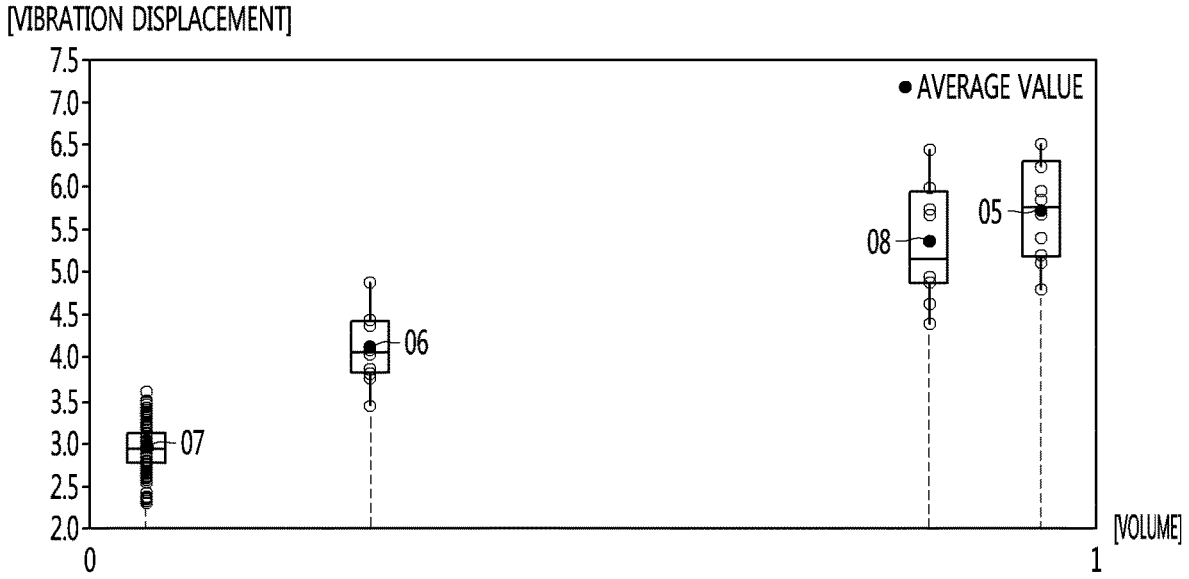
FIG. 7 illustrates experimental data obtained by measuring the vibration data of the load case corresponding to area "D" of FIG. 6.
Figure 8:
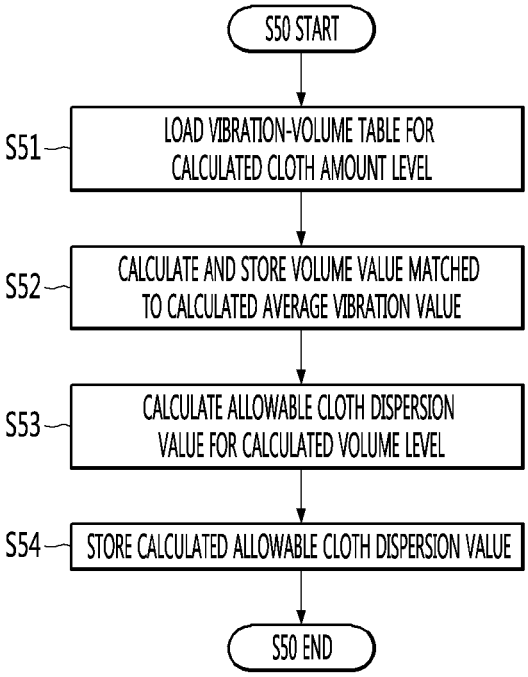
FIG. 8 is a flowchart illustrating a detailed method of a step (S50) of determining the allowable cloth dispersion value according to an embodiment of the present disclosure.

FIG. 6 illustrate experimental data obtained by measuring a load level to a load case in the cloth amount sensing mode according to an embodiment of the present disclosure, FIG. 7 illustrates experimental data obtained by measuring the vibration data of the load case corresponding to area "D" of FIG. 6, and FIG. 8 is a flowchart illustrating a detailed method of a step (S50) of determining the allowable cloth dispersion value according to an embodiment of the present disclosure.

In detail, in FIG. 6, an X axis represents a load case having multiple pieces of laundry having mutually different volumes, and a Y axis represents load data and a cloth amount level for each load case.

For example, the cloth amount level may be defined as level #1 when the weight of the laundry (see Load Data of FIG. 6) is the range of 0 to 420, as level #2 when the weight of the laundry is the range of 420 to 480, as level #3 when the weight of the laundry is the range of 480 to 770, as level #4 when the weight of the laundry is the range of 770 to 930, as level #5 when the weight of the laundry is in the range of 930 to 1220, and as level #6 when the weight of the laundry is in the range of 1220 to 1520.

In other words, the load cases #5, #6, #7, #8 corresponding to the area "D" of FIG. 6 correspond to load cases which are multiple pieces of laundry having mutually different volumes, but the same weight, that is, having the cloth dispersion level corresponding to level #4. For example, the load case #7, which is laundry formed of a very small cotton, may be provided with the minimum volume reference of level #4. In addition, the load case #5 may be clothing worn in winter.

Even though the load cases #5, #6, #7, and #8 have mutually different volumes, the load cases #5, #6, #7, and #8 are determined as having the same cloth amount level in the cloth amount sensing mode. Accordingly, in the conventional washing machine as described above, the same cloth dispersion mode and the same allowable cloth dispersion value are applied to the load cases #5, #6, #7, and #8 to determine the cloth dispersion degree.

In addition, since the conventional washing machine has no separate device or method to distinguish among the volumes of the load cases #5, #6, #7, and #8, the cloth dispersion degree may be determined with respect to each load case.

Meanwhile, in FIG. 7, an X axis represents the volume of the load cases #5, #6, #7, and #8 as a normalized value between 0 and 1, and a Y axis represents the vibration displacement, that is, the vibration value for the load case.

In addition, the X-axis in FIG. 7 indicates that the volume is increased toward '1'. Therefore, the volume of the load case #7 is the smallest and the volume of the load case #5 is the largest.

Referring to FIG. 7, for the load cases #5, #6, #7, and #8, the average vibration value (colored dot) and the volume value may be aligned to be distinguished therebetween. In other words, laundry having the same weight but different in volume may be distinguished using an average vibration value.

Hereinafter, the step S50 of determining the allowable cloth dispersion value will be described in detail with reference to FIG. 8, based on the description of FIGS. 6 and 7.

Referring to FIG. 8, in the determining of the allowable cloth dispersion value (S50), the controller loads, from the memory, the table in which the average vibration value and the volume value are matched to each other in relation to the cloth amount level, which is calculated in the cloth amount level calculating and storing step (S45), (S51).

The memory may store, in advance, a table in which volume values are matched to average vibration values with respect to the cloth amount levels. For example, as illustrated in FIG. 7, the memory may store the matching information of a volume level to an average vibration value of laundry (load case) when the cloth amount level is level #4.

Therefore, the controller may load the table corresponding to the cloth amount level calculated in a previous step.

In addition, the controller may calculate the volume value matched to the average vibration value calculated in the previous step and store the calculated volume value (S52).

For example, when the laundry introduced into the drum 20 is calculated as corresponding to level #4 in the cloth amount level calculating step S45, and the average vibration value is calculated as 5.36 in the average vibration value calculating step S20, the controller may obtain the volume value of 0.8 corresponding to the vibration value of 5.36 through the level #4 table stored in the memory. In addition, the controller may store the calculated volume value of 0.8 in the memory.

In addition, the controller may calculate an allowable cloth dispersion value for the calculated volume value (S53).

In detail, the controller may calculate the allowable cloth dispersion value for the calculated volume value through following Equation 1.

$$\text{Allowable cloth dispersion value}(UB)=(1-w)\times A+w\times B \qquad \text{Equation 1}$$

In Equation 1, "w" denotes the calculated volume value.

In addition, in Equation 1, "A" is the allowable cloth dispersion value when the calculated volume value is zero. The "A" is the allowable cloth dispersion value when the "w" is zero. The "A" is a preset constant.

In addition, in Equation 1, "B" is the allowable cloth dispersion value when the calculated volume value is '1'. The "B" is the allowable cloth dispersion value when the "w" is 1. The "B" is a preset constant.

When the allowable cloth dispersion value, in which the weight and volume factor of the laundry is reflected, is calculated through Equation 1, the controller may store the calculated allowable cloth dispersion value in the memory.

In addition, the controller may determine whether the variation of the rotational speed of the motor 3 satisfies the calculated allowable cloth dispersion value (range) in the step of determining the satisfaction of the allowable cloth dispersion value (S65).

Even though all the elements of the embodiments are coupled into one or operated in the combined state, the present disclosure is not limited to such an embodiment. That is, all the elements may be selectively combined with each other without departing the scope of the disclosure. Furthermore, when it is described that one comprises (or includes or has) some elements, it should be understood that it may comprise (or include or have) only those elements, or it may comprise (or include or have) other elements as well as those elements if there is no specific limitation. Unless otherwise specifically defined herein, all terms comprising technical or scientific terms are to be given meanings understood by those skilled in the art. Like terms defined in dictionaries, generally used terms needs to be construed as meaning used in technical contexts and are not construed as ideal or excessively formal meanings unless otherwise clearly defined herein.

Although embodiments have been described with reference to a number of illustrative embodiments thereof, it will be understood by those skilled in the art that various changes in form and details may be made therein without departing from the spirit and scope of the disclosure as defined by the appended claims. Therefore, the preferred embodiments should be considered in descriptive sense only and not for purposes of limitation, and also the technical scope of the disclosure is not limited to the embodiments. Furthermore, is defined not by the detailed description of the disclosure but by the appended claims, and all differences within the scope will be construed as being comprised in the present disclosure.

What is claimed is:

1. A washing machine comprising:

a cabinet comprising a gasket that is disposed at a front surface of the cabinet, the gasket defining an entrance configured to receive laundry;

a tub disposed inside the cabinet, the tub having a front portion coupled to the gasket;

a spring that connects the cabinet to the tub in a vertical direction;

a drum disposed in the tub and configured to rotate relative to the tub, the drum being configured to receive the laundry through the entrance;

a motor disposed at a rear surface of the tub and configured to generate driving force for rotating the drum;

a controller configured to control the motor to perform a tumble motion of the drum a plurality of times in a rinsing mode by rotating the drum at a preset rotation speed for a preset period in each time of the tumble motion during the rinsing mode; and a vibration sensor configured to sense vibration of the tub and to detect a volume of the laundry, wherein the vibration sensor is disposed at a rear end side defined by the rear surface of the tub and a portion of a side surface of the tub to thereby detect a left-right vibration of the tub, wherein the portion of the side surface of the tub extends toward the entrance from a circumference of the rear surface of the tub, and wherein the controller is configured to:

acquire, by the vibration sensor, data of the left-right vibration of the tub for a total number of times of the tumble motions to be performed in the rinsing mode, and detect the volume of the laundry based on the acquired data of the left-right vibration of the tub.

2. The washing machine of claim 1, wherein the vibration sensor is positioned rearward of the spring and mounted on an outer circumferential surface of the tub.

3. The washing machine of claim 1, wherein the vibration sensor comprises a six-axis vibration sensor.

4. The washing machine of claim 1, wherein the controller is configured to:

terminate the tumble motion when a number of times of performing the tumble motions satisfies the total number of times, calculate an average vibration value based on the data of the left-right vibration of the tub acquired for the total number of times of the tumble motions, calculate a load level based on a measured weight of the laundry, and match the volume of the laundry to the average vibration value for the calculated load level.

5. The washing machine of claim 4, further comprising:

a non-transitory memory having stored a data table including a volume value that matches the data of the left-right vibration and that was determined based on a weight of laundry, wherein the controller is configured to classify the volume of the laundry based on the data table stored in the non-transitory memory.

6. The washing machine of claim 1, wherein the controller is configured to:

determine whether a stabilization duration has elapsed from a start point in each time of the tumble motion; and based on determining that the stabilization duration has elapsed, acquire the data of the left-right vibration of the tub during an acquisition duration subsequent to the stabilization duration.

7. The washing machine of claim 6, wherein the stabilization duration and the acquisition duration are preset, the acquisition duration being longer than the stabilization duration.

8. The washing machine of claim 6, wherein the stabilization duration is preset from 8 to 14 seconds, and wherein the acquisition duration is preset from 15 to 20 seconds subsequent to the stabilization duration.

9. The washing machine of claim 1, wherein the controller is configured to count a number of the tumble motions when each tumble motion is terminated.

10. The washing machine of claim 9, wherein the controller is configured to determine whether a number of times of performing the tumble motions satisfies the total number of times of the tumble motions after acquiring the data of the left-right vibration of the tub.

11. The washing machine of claim 10, wherein the controller is configured to repeat acquiring the data of the left-right vibration of the tub when the number of times of performing the tumble motion does not satisfy the total number of times.

12. The washing machine of claim 11, wherein the controller is configured to store the data of the left-right vibration of the tub in a non-transitory memory.

* * * * *